US005779114A

United States Patent [19]

Owens

[11] Patent Number: 5,779,114

[45] Date of Patent: Jul. 14, 1998

[54] SAFETY HOLSTER

[76] Inventor: William Rex Owens, 40182 LaRoche Rd., Prairieville, La. 70769

[21] Appl. No.: 684,377

[22] Filed: Jul. 19, 1996

[51] Int. Cl.[6] ..... F41C 33/04

[52] U.S. Cl. ..... 224/193; 224/243; 42/1.01

[58] Field of Search ..... 224/193, 243; 42/70.01, 70.11, 1.01

[56] References Cited

U.S. PATENT DOCUMENTS 3,530,451 9/1970 Devine .
4,541,191 9/1985 Morris et al. ..... 42/1.01
5,108,019 4/1992 Woodward et al. ..... 224/243
5,487,234 1/1996 Dragon ..... 42/70.07
5,525,966 6/1996 Parish ..... 224/243 X
5,598,151 1/1997 Torii, Jr. ..... 340/825.32

*Primary Examiner*—Renee S. Luebke
*Attorney, Agent, or Firm*—Roy, Kiesel & Tucker

[57] ABSTRACT

A safety device for a firearm comprising a receptacle adapted to receive a firearm, the receptacle having a first signal means for generating a first status signal reflecting the status of the receptacle as to whether a firearm is engaged or disengaged in the receptacle.

26 Claims, 6 Drawing Sheets

SAFETY HOLSTER

BACKGROUND OF THE INVENTION

1. Field of the Invention

This invention relates generally to firearm safety devices, and more particularly to safety receptacles, such as a safety holster, which provide an indication as to the status of the holster as weapon engaged or weapon disengaged with the holster.

2. Prior Art

Firearms, such as handguns, shotguns and rifles, obviously prevent a danger if used by one not the owner. For instance, children have been known to gain access to a firearm for "play," often with deadly consequences, either to themselves or others. Firearms can also present a danger to the owner; for instance, a thief could remove a firearm from the owner's car or home and use the stolen weapon against the owner, or police investigating the theft. Present attempts to safely store firearms generally involves "hiding" the firearm, or storing the firearm in a locked location, such as a safe or locking gun cabinet. Such storage, however, can be ineffective for several reasons: the stored firearm now fails to be easily accessible for emergency use; or (2), the locking cabinet is easily broken into. One approach taken to address this problem is to modify the holster to prevent easy withdrawal of a weapon from the holster. Such a device is shown in U.S. Pat. No. 5,150,825 to Nichols, or U.S. Pat. No. 5,419,474 to Marx, both herein incorporated by reference.

However, prior art has not addressed the problem from the standpoint of providing an alarm mechanism to notify the weapon's custodian or security forces that the weapon is being removed.

OBJECTS OF INVENTION

It is an object of the present invention to provide a firearm receptacle for a firearm with a means for alerting one that the weapon may be withdrawn.

It is another object of the present invention to provide a firearm receptacle for a firearm with a means for alerting one that the weapon has been withdrawn from the receptacle.

It is another object of the present invention to provide a firearm receptacle for a firearm, with a means for alerting a remote alarm system that the firearm maybe or has been withdrawn.

It is another object of the present invention to provide a firearm receptacle for a firearm, which can record when the firearm has been removed for the receptacle, or transmitting such information to a remote location.

SUMMARY OF INVENTION

Accordingly, a safety device for a firearm is provided. The device includes a receptacle adapted to receive a firearm, and has a first signal means for generating a first status signal reflecting the status of the receptacle as to whether a firearm is engaged or disengaged in the receptacle. The first signal means can be a switch adapted to be opened or closed by the presence of a portion of a firearm in the receptacle. A first alarm may be included, the first alarm being responsive to the first signal means. Alternatively, the signal generated by the first signal means may be transmitted to a remote location, such as a police or local security office, providing remote notification of the status of the receptacle, such as weapon has been removed. One such receptacle is a holster for a handgun; another such receptacle is a stand for a rifle or shotgun.

The firearm receptacle may have a releasable retention device for retaining a firearm positioned in the receptacle, such as a retaining strap on a holster. The receptacle may have a second signal means for generating a second status signal reflecting the status of the retention device as opened or closed. The second signal means may be a switch. A second alarm may be included in the device for responding to the second status signal.

DETAILED DESCRIPTION

Figure 1A:
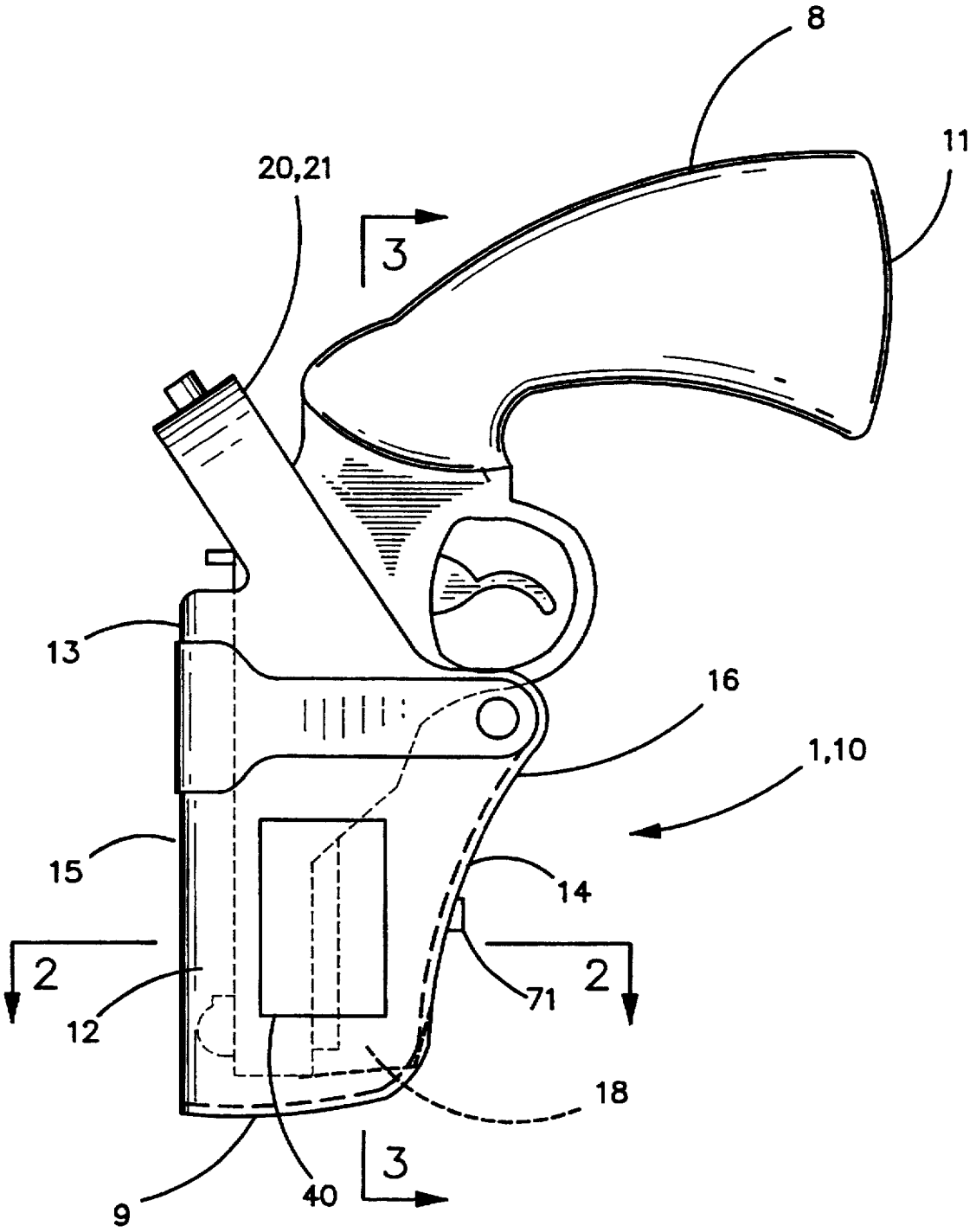
FIG. 1A is a side view of a holster embodiment of the invention.
Figure 1B:
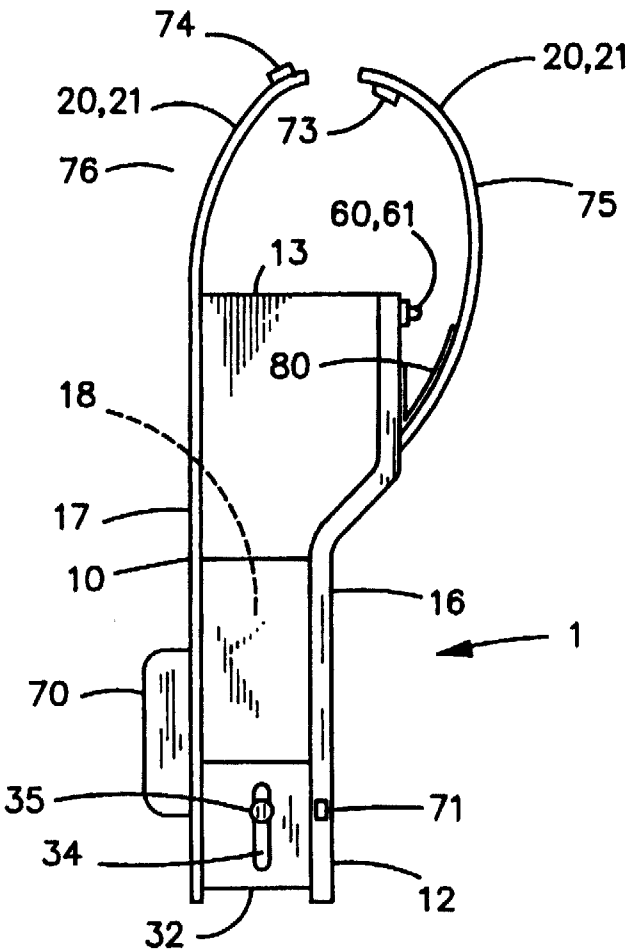
FIG. 1B is a back view of a holster embodiment of the invention.

FIG. 1 shows a receptacle 1, in this instance a holster 10, sized to receive a firearm, shown as a handgun 11. Receptacle, as used in this document, is meant to encompass any apparatus adapted to store a firearm, such as the slots in a gun cabinet, or a rifle rack for use in a truck, or a rifle carriage for use in local police armories etc. Firearm has a muzzle 9 and a butt 8. Shown in FIG. 1 is a releasable retention device 20 for retaining a firearm in an engaged position in the receptacle 1. As shown in FIG. 1, retention device 20 is a clipable strap 21. Holster 10 has a muzzle end 12, a butt end 13, a back 14, a front 15, a body side 16 and a hand side 17. Back 14, front 15 and sides 16 and 17 define an interior 18 and an exterior 19. Interior 18 is adapted to receive a handgun 11.

Figure 2:
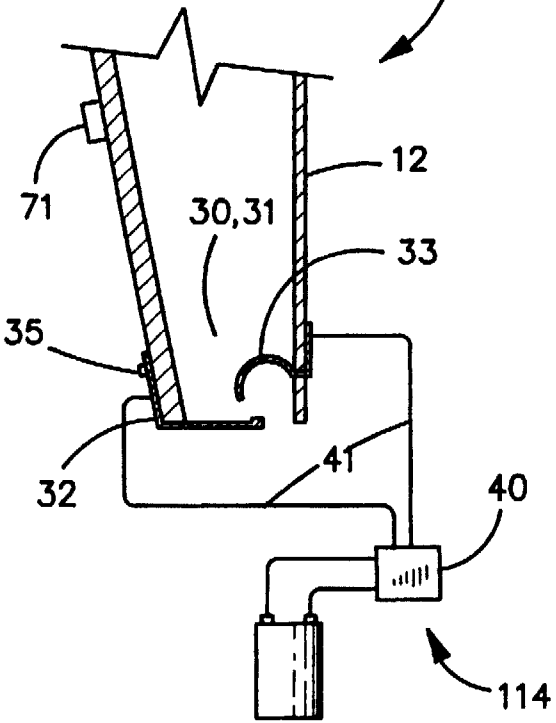
FIG. 2 is a sectional side view of the holster embodiment taken through line 2—2 of FIG. 1.

As is shown in FIG. 2, located at muzzle end 12 is a first signal means 30 for generating at first status signal reflecting the status of the receptacle 1 as to whether a firearm is engaged or disengaged in the receptacle 1. As shown, first signal means 30 is a first switch 31. First switch 31 has a first contact 32 and a second contact 33, positioned near muzzle end 12 of holster 10. The first status signal is generated by an indication of open or closed contacts on first switch 31.

First contact 32 and second contact 33 are metal strips, designed to form an electrical contact switch. As shown, second contact 33 is a deformable piece of spring steel, having a "U" shape. First contact 32 may also be formed of deformable spring steel. First contact 32 and second contact 33 are electrically connectable to box 40 through wiring 41 or other means. Box 40 may be a variety of devices which will be described later. Box 40 may be located on receptacle 1 or be remote from receptacle 1.

When a handgun 11 is placed in the interior 18 of holster 10, the muzzle 9 of handgun 11 will come in contact with second contact 33. As handgun 11 is fully engaged in interior 18 of holster 10 (engaged is used in the sense that the handgun is in its resting position in receptacle), the spring steel of second contact 33 is forced downward into contact with first contact 32. To accommodate different sized handguns, particularly different muzzle lengths, the position of first contact 32 or second contact 33 (or both) may be adjustable with respect to holster 10. As shown first contact 32 is slidably adjustable by means of slot 34 through first contact 32 with adjustment set by set screw 35 positioned through slot 34 and engaging a threaded opening in receptacle 1.

First switch 30 may be located in positions on the receptacle 1 other than near the butt end 13. However, when receptacle 1 is a holster, the butt end 13 location is preferred as a. switch positioned on the butt end 13 will generally provide an earlier indication that a firearm is being removed from the holster 10. Other switch embodiments besides a contact type switch may be used, such as a pressure switch, a single micro-switch, a proximity switch, a magnetic switch, an electromagnetic "eyebeam" switch, etc. Alternatively, first contact 32 and second contact 33 may be designed not to directly contact one another, but to come into electrical contact through the metal of a firearm when such is positioned in the interior 18 of the holster 10. As described, the first switch 30 provides a first status signal reflecting the status of the receptacle 1. In the configuration shown, electrical continuity through first switch 30 reflects that a firearm has engaged the receptacle 1, with an electrically open condition reflecting that the firearm has disengaged from the receptacle 1. Obviously, this configuration could be reversed, with continuity reflecting weapon disengaged and an open condition reflecting engagement.

First signal means 30 is electrically connectable to box 40. Box 40 may be an alarm located on receptacle 1, or a remote alarm, such as contained in a home security system or an automobile security system. Alternatively, box 40 may be a transmission device, such as a radio transmitter located on receptacle 1, to transmit the status of the receptacle 1 to a remote device, such a remote alarm, or a remote recording device, to record the status of the receptacle 1. Box 40 may also be a recording device positioned on receptacle 1, such as a microprocessor equipped with clock and memory, to record the status of the receptacle 1. Preferably box 40 will have a means to download the recorded information. "Recording the status" includes recording only a change in the status of receptacle 1, such as a change from firearm engaged to disengaged, or only recording a desired change in status. For instance, there may be no interest in recording the status change from disengaged to engaged. Alternatively, "recording" can mean continuous or periodic recording of status, or recording of a desired change in status and of time elapsed until the receptacle 1 status reverts to the previous state. Additionally, if box 40 is equipped with a clock means, "recording the status" can include recording the time at which the status changes or elapsed time from a status change, or recording of status and time. "Transmitting the status" includes transmitting only a change in the status of receptacle 1, such as a change from firearm engaged to disengaged, or only transmitting a desired change in status. For instance, there may be no interest in transmitting the status change from disengaged to engaged. Alternatively, "transmitting the status" can mean continuous or periodic transmission of status, or transmission of a desired change in status and of time elapsed until the receptacle 1 status reverts to the previous state. Additionally, if box 40 is equipped with a clock means, "transmitting the status" can include transmitting the time at which the status changes or elapsed time from a status change, or transmitting of status and time.

Figure 3:
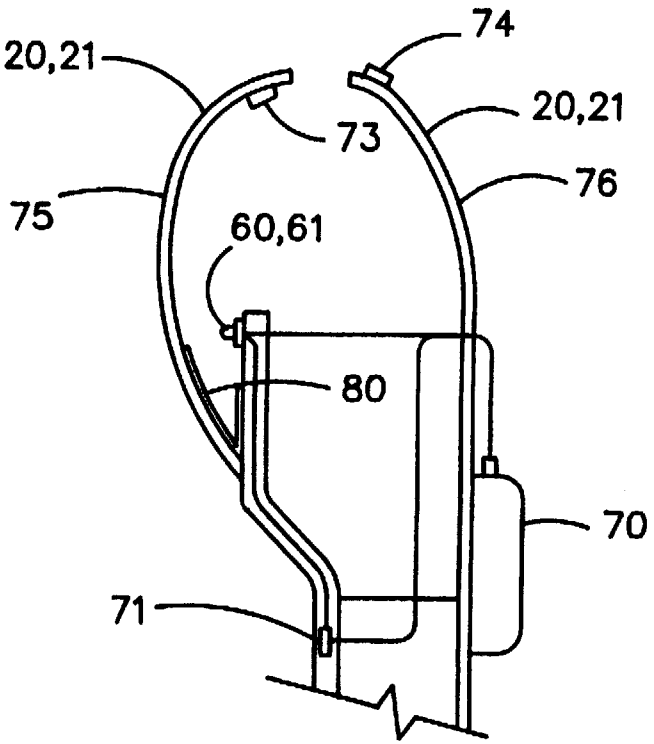
FIG. 3 is a sectional view of the holster embodiment taken through line 3—3 of FIG. 1.

Shown in FIG. 3 is second signal means 60 for generating a second status signal reflecting the status of the retention device 20. Retention device 20 is a strap 21 located near butt end 13 of holster 10, and has two pieces, a body piece 75 and a hand piece 76, the pieces equipped with mating fasteners, such as interlocking metal snaps 73 and 74. The two pieces 75, 76 of the retention device 20 are designed to wrap over the butt 8 of a firearm positioned in the interior 18 of the holster 10, thereby retaining or "locking" the weapon in the interior 18 of the holster 10. Obviously, a single piece strap 21 engagable with the opposing side wall of holster 10 could also act as a retention device. For a gun rack embodiment, the retention device may be a sliding or pivoting bar engagable with the gun rack designed to lock the rifle or shot gun in position in the rack, or a trigger-guard type lock.

Second signal means 60, as shown, is a pressure actuated micro-switch 61 positioned on the body side 16 of butt end 13 of holster 10. Also shown is biasing spring 80 attached to body side 16 of butt end 13 of holster 10, and positioned between body piece 75 of strap 21 and holster 10. Biasing spring 80 biases the strap piece 75 away from holster 10 when retention device 20 is opened or released, preventing retention device 20 piece from providing a false second status signal by contacting micro-switch 61.

Micro-switch 61 is electrically connected to second alarm 70 which alarm is shown positioned on the hand side of holster 10. Second alarm 70 includes an integral battery, but the battery may be separate. Second alarm 70/micro-switch 61 combination is configured to sound an alarm if micro-switch 61 is open. In this fashion, the alarm circuit of micro-switch 60 and second alarm 70 could not be "disarmed" by cutting the electrical connection between micro-switch 60 and second alarm 70; in fact, cutting the electrical connection would result in an open circuit setting off second alarm 70. However, it may be advantageous to have a disarming switch 71 to disarm second alarm 70. Preferably, disarming switch 71 will be a keyed switch to only allow the one having the key to disarm the circuit.

Other embodiments of switches could also be used. For instance, the metal snaps 73 and 74 could be electrically or magnetically connectable, for instance by wires embedded in the straps, thus forming a contact-type switch or a magnetic type-switch.

Second signal means 60 and first signal means 30 could be wired to the same alarm, and be disarmed by the same disarming switch. However, the preferred embodiment, incorporating both signal means, would have each signal means electrically tied to its own alarm with separate disarming switches. This apparent "redundancy" provides additional flexibility. For instance, if the first signal means 30 is electrically connected to a silent home alarm, and the second signal means 60 is electrically connected to a non-silent alarm, the owner, in a burglary type situation, will want to disable the second signal means 60 in order to draw the weapon without sounding the audible alarm, but still desire to have the silent alarm notify the police that a weapon has been drawn. If the owner is not present, the owner may wish both alarms to be enabled; the first alarm sounding in an attempt to scare off a burglar or child from drawing the weapon, and if the weapon is drawn, to notify the police or other emergency responsive agency through the second silent alarm which is responsive to the second signal means that a weapon has been drawn.

Figure 4B:
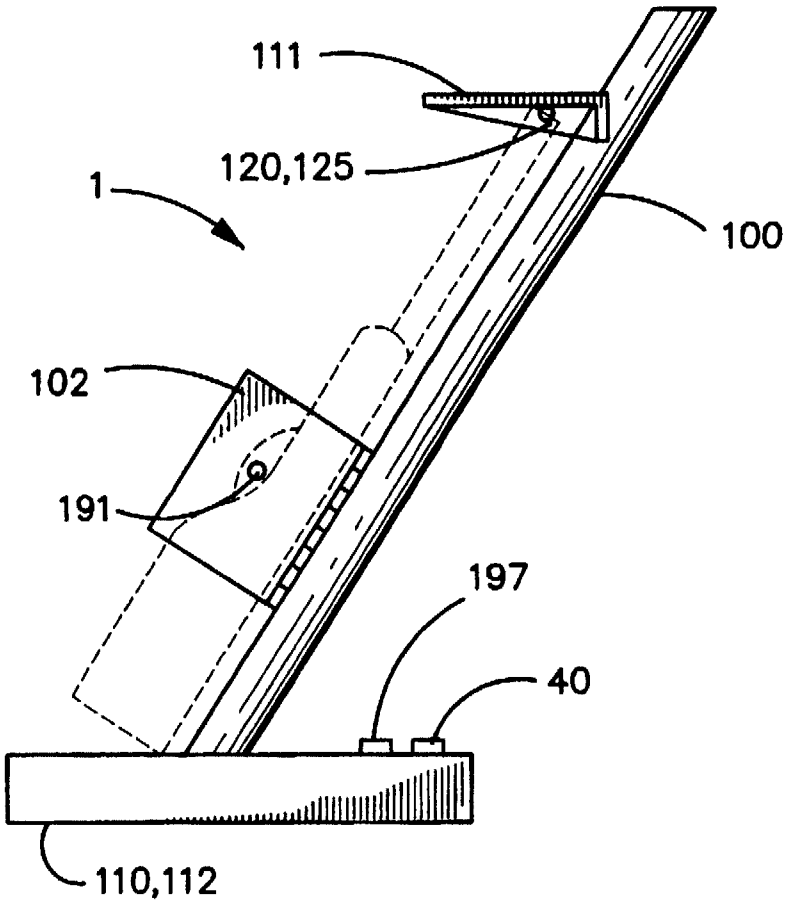
FIG. 4B is a side view of second embodiment of the first signal means.
Figure 4A:
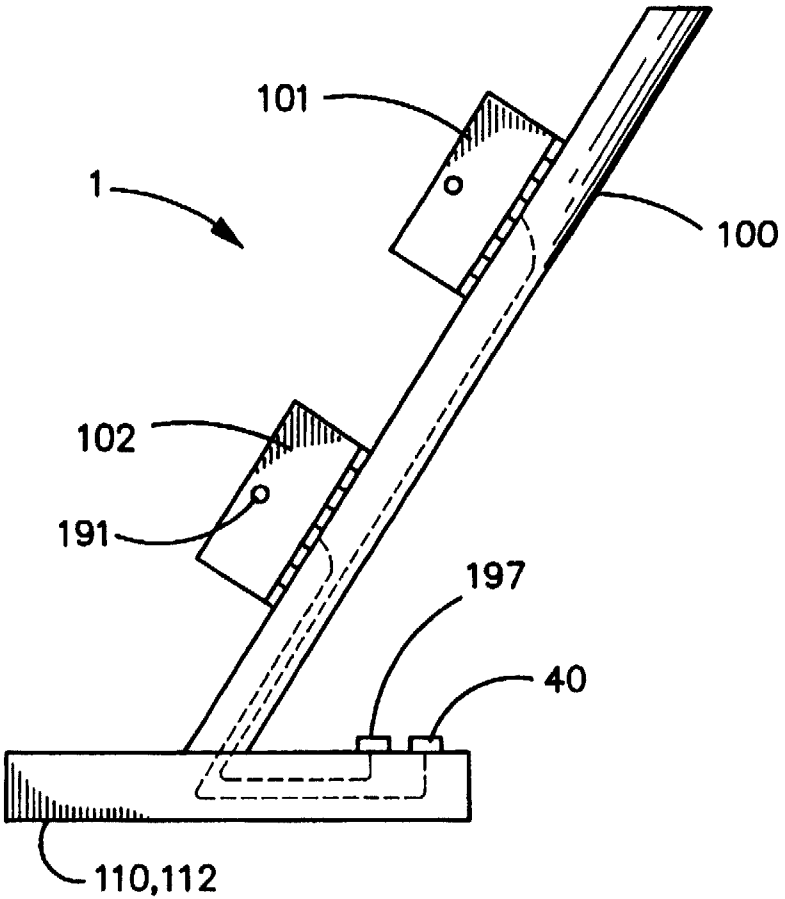
FIG. 4A is a side view of a gun rack embodiment of the invention.
Figure 5:
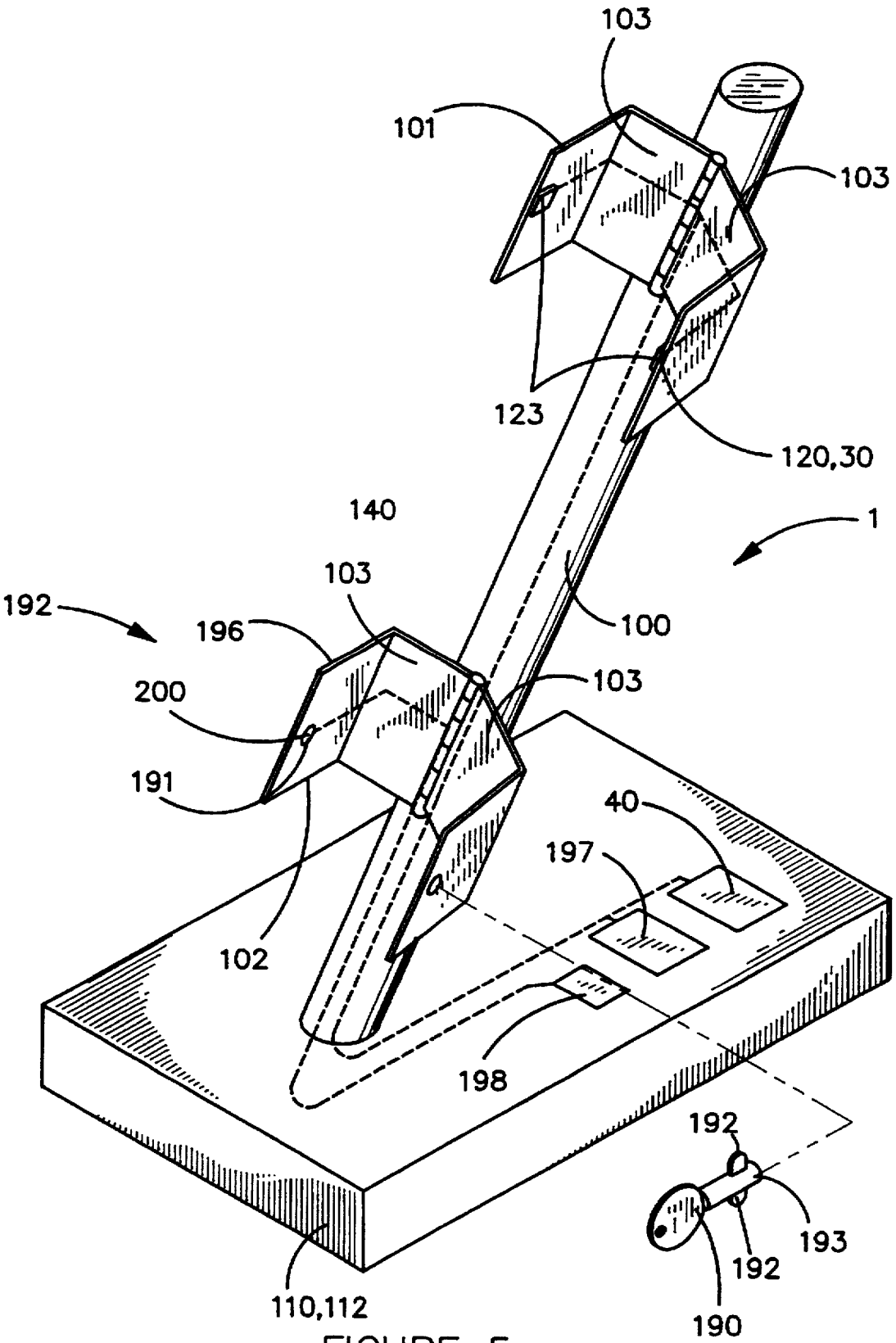
FIG. 5 is a front view of the gun rack embodiment of the present invention depicted in FIG. 4A.

Shown in FIG. 4A and FIG. 5 is a embodiment of the present invention to accommodate a rifle or a shotgun. Receptacle 1 includes a hollow bar 100 having attached thereto a first clamp 101 and second clamp 102. Clamp 101 is adapted to hold the muzzle end of a rifle, while clamp 102 is adapted to hold the butt end of a rifle. Both clamps 101 and 102 thus operate retention devices. As shown in FIG. 5, clamps 101 and 102 are two facing plates with a spring hinge. First 101 and second clamps 102 may be positionally adjustable with respect to one another on bar 100, such as by being slidable on the bar 100, in order to accommodate different lengths of firearms. As shown, the clamps 101 and 102 are spring loaded clamps, which may be spring loaded to open or be spring loaded to close. Preferably, clamps 101 and 102 have a mar resistant lining 103, such as a neoprene type fabric layer, placed on the clamping surfaces to prevent the clamps from marring a weapon placed therein. Bar 100 is connected to mounting means 110 to mount bar 100 to a surface. In the configuration shown, mounting means 110 is a plate member 112. Mounting means may be hook or suction cups to mount bar 100 onto a truck or other vehicle.

First signal means 30 for generating a first status signal reflecting the status of the receptacle as to whether a firearm is engaged or disengaged in said receptacle 1 is first switch 120 located on first clamp 101. As shown, first switch 120 is a proximity switch, such as a magnetic switch with two magnetic contact plates 123, one each located on opposing faces of first clamp 101, the contact plates 123 are designed to magnetically connect when first clamp 101 is closed. First switch 120 is connected to box 40 through wires 140 which wires are shown traveling from the switch along clamping surfaces through hollow bar 100 to box 40. As before, box 40 may be an audible alarm or a remote alarm, a transmission device to transmit status of receptacle 1, or a recording device to record same. Alternatively, the recording, alarm or transmission device may be attached to first clamp 101 or bar 100.

Box 40 may be configured to sound an alarm when first switch 120 either is open or closed. Preferably, first clamp 101 is biased closed, and when a rifle muzzle is placed therein, the first clamp is forced open, opening circuit comprising box 40 as shown in FIG. 2, power source (which may be a battery 114 internal to box 40) and first switch 120. In this configuration, when box 40 is an alarm, whether remote or attached, the alarm should be adapted to alarm when first switch is closed, indicating weapon is disengaged. If first clamp 101 is biased open, the first clamp 101 must have a closing device, such as a pin engagable with the two faces of first clamp 101 or a clasp to secure the two faces of first clamp 101 closed when muzzle end of rifle is place therein.

An alternative first signal means 30 is shown in FIG. 4B. Shown is bar 100, with a top plate 111 adjustably connected to bar 100. Positioned on top plate 111 is first switch 120, shown as a pressure switch 125. Pressure switch 125 is designed to contact the muzzle end of rifle or shot gun. First switch 120 may also be positionable on bar 100 and actuated by placement of rifle in receptacle 1. As in other embodiments, pressure switch is connectable to box 40, electrically or by transmission of signals.

Preferably, second clamp 102 is biased open, with a closing device to enable second clamp to close, such as pin 190 engagable with alignable openings 191 in each facing plate of second clamp. Pin 190 may have a biased ball bearing type retention means 192 positioned on pin end 193 to keep pin 190 from withdrawing after insertion through alignable openings 191 and thereby maintaining second clamp 102 closed. Pin 190 may also be adapted to function as a trigger guard, that is, alignable openings 191 are positioned so that when rifle is placed in receptacle 1 and pin is inserted through openings 191, pin 190 passes behind trigger of rifle, preventing trigger from being pulled. Second clamp 102 thus operates as a retention device to retain rifle in receptacle 1. Positioned on second clamp 102 is second signal means 60 for generating a second status signal reflecting the status of the retention device 1 as open or closed. Second signal means 60 is a second switch 122. In the embodiment shown, second switch is a conductive wire 196 position on second clamp faces. Conductive wire 196 is connected to alarm 197 through keyed disablement switch 198 mounted on plate 110. The conductive wire 196 has open ends 200 electrically connected to alignable openings 191. In this fashion, when a electrically conductive pin 190 is inserted through alignable openings 191, a closed circuit is formed. Alarm 197 should be adapted to alarm when second switch is open or non-conductive, which condition reflects the fact that the second clamp 102 is open.

Figure 6:
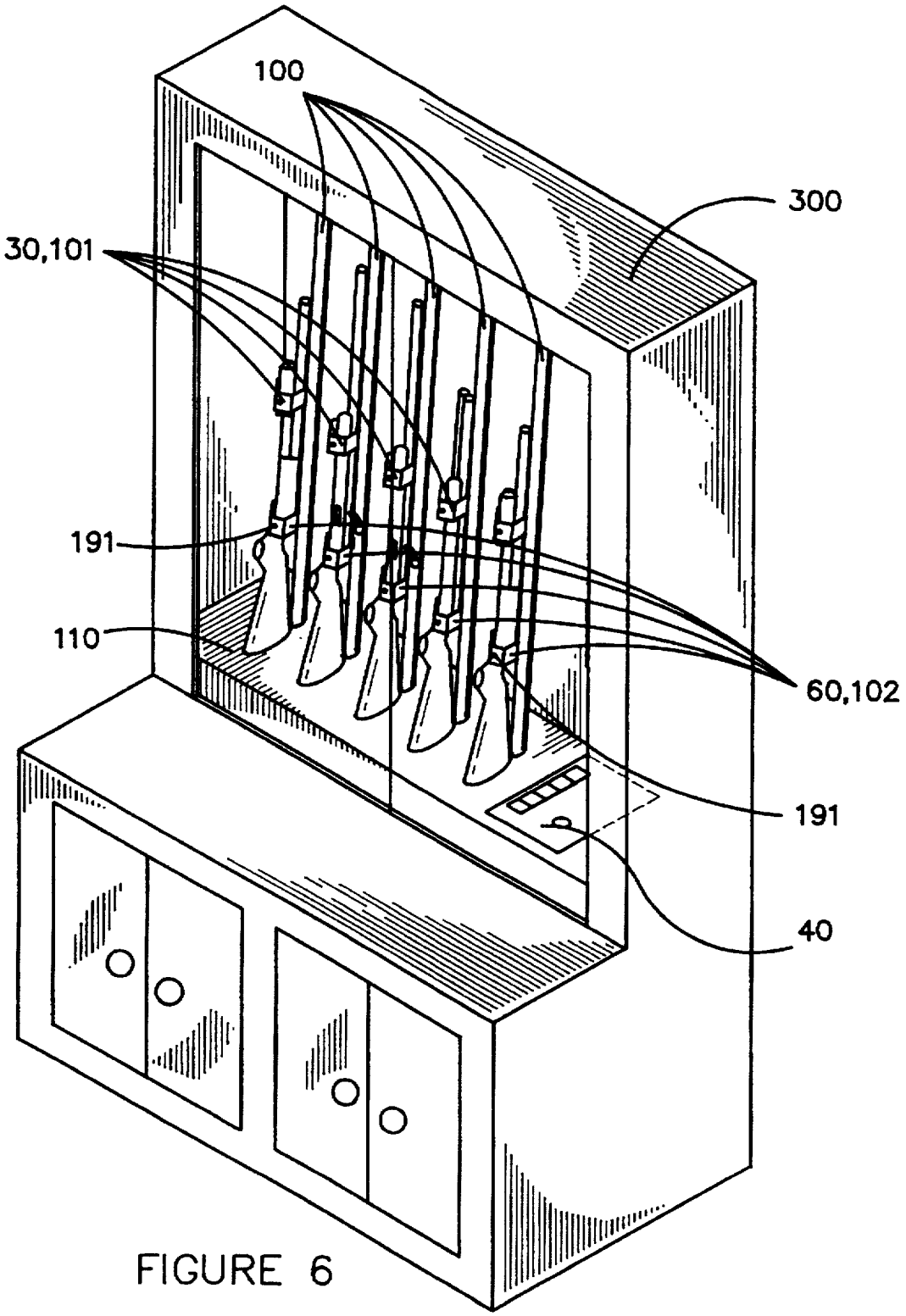
FIG. 6 shows the invention embodied in a gun rack.

Shown in FIG. 6 is gun cabinet 300, capable of holding multiple firearms. Shown are several retention devices 1, each having bar 100, and all sharing a common plate 110. Bars 100 may not be necessary as clamps 101 and 102 could be mounted to the frame of gun cabinet 300. Most, but not all, of the retention devices 1 shown use both first clamp 101 and incorporated first switch 120 (first signaling means 30), and second clamp 102 and incorporated second switch 122 (second signaling means 60) and pins 191. Also shown is box 40, to which all retention devices 1 are wired. It is preferred that each and every retention device 1 have separate disabling switches to disable either first signaling means 30 or second signaling means 60, or both. As can be seen in FIG. 6, the relative positions of first clamp 101 and second clamp 102 may be adjustable to accommodate different firearms.

I claim:

1. A safety device for a firearm comprising a receptacle adapted to receive a firearm, said receptacle having a status as to whether a firearm is engaged or disengaged in said receptacle, said receptacle having a first signal means for generating a first status signal reflecting said status of said receptacle, said safety device further having a tracking device, said tracking device responsive to said first status signal and adapted to record the status of said receptacle, said tracking device being attached to said receptacle.

2. An apparatus according to claim 1 further having a first alarm responsive to said first status signal.

3. An apparatus according to claim 2 wherein said first alarm is activated when a firearm is disengaged from said receptacle.

4. An apparatus according to claim 2 wherein said receptacle is a holster.

5. An apparatus according to claim 2 wherein said receptacle is sized to accommodate a rifle or shotgun.

6. An apparatus according to claim 2 wherein said first signal means comprises a first switch positioned on said receptacle, said first switch connectable to a power source.

7. An apparatus according to claim 6 wherein said first switch is a contact switch, operable by the contact of a portion of a firearm on said contact switch when a firearm engages said receptacle.

8. An apparatus according to claim 7 wherein said device further has a power source, said contact switch being electrically connected to said power source.

9. An apparatus according to claim 7 wherein said receptacle has a muzzle end for receiving the muzzle of a firearm, said contact switch being located in said muzzle end.

10. An apparatus according to claim 2 further having a first alarm disarming device adapted to disarm said alarm.

11. An apparatus according to claim 10 wherein said first alarm disarming device is a keyed switch.

12. An apparatus according to claim 1 further having a transmission device responsive to said first status signal, said tracking device adapted to transmit the status of said receptacle to a receiving device.

13. An apparatus according to claim 12 wherein said tracking device comprises a clock circuit with memory.

14. A safety device for a firearm comprising a receptacle sized to receive a firearm, said receptacle having a status as to whether a firearm is engaged or disengaged in said receptacle, said receptacle having a retention device adapted to retain a firearm positioned in said receptacle, said retention device being openable and closable, and a second signal means for generating a second status signal reflecting the status of the retention device as open or closed, said safety device further having a tracking device, said tracking device responsive to said second status signal and adapted to record said status of said receptacle, said tracking device being attached to said receptacle.

15. An apparatus according to claim 14 wherein said receptacle is a holster, said holster having a muzzle end and a butt end, and said retention device is located near said butt end.

16. An apparatus according to claim 14 wherein said second signal means comprises a second switch connectable to a power source.

17. An apparatus according to claim 16 further having a second alarm responsive to said second status signal.

18. An apparatus according to claim 17 wherein said second alarm is configured to activate when said retention device is opened.

19. An apparatus according to claim 18 wherein said device further has a power source, said second switch and said second alarm being electrically connected to said power source.

20. An apparatus according to claim 18 further having a second alarm arming device adapted to arm said second alarm.

21. An apparatus according to claim 20 wherein said second alarm arming device is a keyed switch.

22. An apparatus according to claim 14 further having a first signal means for generating a first status signal reflecting the status of the receptacle as to whether a firearm is engaged or disengaged in said receptacle.

23. An apparatus according to claim 22 wherein said first signal means comprises a first switch connectable to a source of power, and said second signal means comprises a second switch connectable to a source of power.

24. An apparatus according to claim 23 further having a first alarm, said first alarm responsive to said first status signal.

25. An apparatus according to claim 24 wherein said receptacle is a holster.

26. An apparatus according to claim 25 further having at least one power source, said first alarm and said first and said second switches electrically connected to said at least one power source.

* * * * *